US009472101B2

(12) United States Patent
Schulz et al.

(10) Patent No.: US 9,472,101 B2
(45) Date of Patent: Oct. 18, 2016

(54) SYSTEM AND METHOD FOR RECOGNIZING A PARKING PLACE THAT IS POTENTIALLY BECOMING FREE

(71) Applicant: Bayerische Motoren Werke Aktiengesellschaft, Munich (DE)

(72) Inventors: Ralf Schulz, Puchheim (DE); Sebastian Winter, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 90 days.

(21) Appl. No.: 14/282,096

(22) Filed: May 20, 2014

(65) Prior Publication Data

US 2014/0347196 A1 Nov. 27, 2014

(30) Foreign Application Priority Data

May 21, 2013 (DE) ..... 10 2013 209 298

(51) Int. Cl.
*G08G 1/14* (2006.01)
*G08G 1/0967* (2006.01)

(52) U.S. Cl.
CPC ..... *G08G 1/143* (2013.01); *G08G 1/096716* (2013.01); *G08G 1/096758* (2013.01); *G08G 1/096791* (2013.01); *G08G 1/147* (2013.01)

(58) Field of Classification Search
CPC ..... B60Q 1/48; G08G 1/143
USPC ..... 340/932.2
See application file for complete search history.

(56) References Cited

U.S. PATENT DOCUMENTS

| | | | | |
|---|---|---|---|---|
| 7,088,262 | B2 | 8/2006 | Schindler et al. | |
| 2007/0040701 | A1* | 2/2007 | Browne | G08G 1/14 340/932.2 |
| 2010/0302068 | A1* | 12/2010 | Bandukwala | H04W 4/046 340/932.2 |
| 2011/0133957 | A1* | 6/2011 | Harbach | G08G 1/14 340/932.2 |
| 2011/0140922 | A1* | 6/2011 | Levy | G01C 21/3685 340/932.2 |
| 2012/0062395 | A1 | 3/2012 | Sonnabend et al. | |
| 2012/0200430 | A1 | 8/2012 | Spahl | |
| 2012/0262305 | A1 | 10/2012 | Woodard et al. | |
| 2013/0257632 | A1* | 10/2013 | Harber | G08G 1/0112 340/932.2 |
| 2015/0130638 | A1* | 5/2015 | Bahgat | G08G 1/146 340/932.2 |

FOREIGN PATENT DOCUMENTS

| | | |
|---|---|---|
| DE | 102 50 021 A1 | 5/2004 |
| DE | 10 2011 003 772 A1 | 8/2012 |

OTHER PUBLICATIONS

German Search Report dated Jan. 31, 2014 with partial English translation (ten (10) pages).

* cited by examiner

*Primary Examiner* — Brent Swarthout
(74) *Attorney, Agent, or Firm* — Crowell & Moring LLP

(57) ABSTRACT

A mobile system is provided for a vehicle for recognizing a parking place that is potentially becoming free, along with a method for recognizing a parking place that is potentially becoming free. The system includes at least one sensor for detecting a signal that is typical for a parking place that is potentially becoming free, an evaluation unit for assessing whether a signal received by the sensor signifies a parking place that is potentially becoming free, and an optical and/or acoustic indicator unit for indicating a parking place that is potentially becoming free. With the system and method, parking places that are becoming free can be detected automatically when travelling through a specific road section.

20 Claims, 3 Drawing Sheets

SYSTEM AND METHOD FOR RECOGNIZING A PARKING PLACE THAT IS POTENTIALLY BECOMING FREE

CROSS REFERENCE TO RELATED APPLICATIONS

This application claims priority under 35 U.S.C. §119 to German Application No. 10 2013 209 298.9, filed May 21, 2013, the entire disclosure of which is herein expressly incorporated by reference.

BACKGROUND AND SUMMARY OF THE INVENTION

The invention relates to a system and method for recognizing a parking place that is potentially becoming free and to a vehicle with such a system.

In some parking lots individual parking places are detected by use of sensors to determine whether the respective parking place is free or occupied. These data are assembled in a central control device, so that the control device can control a parking guidance system in such a way that a vehicle arriving in the parking lot quickly finds a parking place.

Furthermore, there are programs for smartphones by which parking places that are becoming free can be reported to a central server. These notifications about parking places becoming free are provided with a time stamp. Another user of this system can call up the parking places that are becoming free and occupy the corresponding parking place (for example ParkMe, Google open spot).

Furthermore, there is a system that, by use of statistical data, displays to a user the road sections on which it is easy or difficult to find a parking space (www.faspark.com).

The individual systems have proved successful in their respective applications, but the parking guidance system of a parking lot is limited to the respective parking lot, the management of free parking places by means of an Internet server is dependent upon the reports from individual users, and the statistical evaluation of individual road sections may deviate considerably from the actual parking place situation.

DE 102 50 021 A1 discloses a method for operating a display system in a vehicle for finding a parking place, wherein a parking space is detected by use of an optical camera.

The object of the invention is to provide a system and method for recognizing a parking place that is potentially becoming free.

A further object of the invention is to provide a system and method for recognizing a parking place that is potentially becoming free, that are not limited to a specific variety nor dependent upon the co-operation of users, but automatically recognizes parking places that are potentially becoming free.

These objects are achieved by a mobile system, a method and a vehicle as claimed herein.

A mobile system for a vehicle for recognizing a parking place that is potentially becoming free comprises:

(a) at least one sensor for detecting a signal typical of a parking place that is becoming free, (b) an evaluation unit for assessing whether a signal received by the sensor signifies a parking place that is potentially becoming free, and (c) an optical and/or acoustic indicator unit for indicating a parking place that is free or potentially becoming free.

A "parking place that is potentially becoming free" is a parking place occupied by a vehicle, wherein at least one signal that is typical for a parking place that is becoming free is detected by the sensor, so that there is a certain probability that the vehicle parked on the parking place will shortly leave the parking place. In the assessment of whether a signal received by the sensor signifies a parking place that is potentially becoming free, this probability is calculated by the evaluation unit and a corresponding optical or acoustic indication is output by the indicator unit.

With this indication, in the search for a parking place it is considerably easier to find a parking place that is becoming free.

The at least one sensor may be a camera, a microphone, a receiver of radio waves, an ultrasound sensor, a radar, a thermal imaging camera, a satellite-based position sensor (for example GPS), a wireless data link or a combination of two or more such sensors.

If the at least one sensor is, for example, a camera, a microphone, a receiver of radio waves, an ultrasound sensor, a radar, a thermal imaging camera, a satellite-based position sensor (for example GPS), a wireless data link or a combination of two or more such sensors, then the signals detected thereby cannot be picked up directly by a human and assist a user of a vehicle.

While humans can indeed hear, a user of a parking place finder system who is sitting in a vehicle can hardly discern the sound of a running engine of a vehicle on a parking area. However, this can be readily detected by way of a microphone mounted, in particular, externally on the vehicle. In this case microphone signals can be processed, for example frequency-filtered, in particular using data links. The roadway and the traffic signs can also be recognized with the human eye, but for a driver in a moving vehicle it is hardly possible to optically register the area to the side of the vehicle. Thus, with a microphone in particular directed specifically onto this area and/or with a camera that in particular records this area, additional signals are received that a driver could not pick up or could only pick up with difficulty.

The evaluation unit is preferably constructed in such a way that predetermined signal patterns of one or more of the detected signals are assessed as a parking place that is free or potentially becoming free.

In particular, the evaluation unit is constructed in such a way that predetermined signal patterns of at least two different signals are assessed as a parking place that is potentially becoming free. By the combination of two different signals the reliability of the assessment of the signals as a potentially free parking place can be increased considerably by comparison with the use of only one single signal.

The following signal patterns may be assessed as a parking place that is potentially becoming free:

(1) An ultrasonic signal that in road traffic typically originates from a parking place spacing system. Such an ultrasonic signal is emitted by a vehicle when parking in or leaving a parking place.

(2) An optical image analysis of a vehicle, in particular (a) with regard to its position and the flashing light signals emitted by the respective vehicle, (b) with regard to the switching on of vehicle lights by comparison of chronologically staggered images of the vehicle, (c) with regard to the switching off of vehicle interior lighting by comparison of chronologically staggered images of the vehicle, and/or (d) with regard to pedestrians either moving purposefully towards a vehicle and/or holding a key in hand. Thus, with such an optical image analysis of a vehicle or of pedestrians, it may be ascertained whether a vehicle is in a typical position for leaving a parking place and/or due to the switching on or switching off of vehicle lights or vehicle interior lighting it is probable that the vehicle is leaving the corresponding parking place, or a pedestrian is moving purposefully towards a vehicle, so that it is probable that he is leaving a parking place with a vehicle.

(3) A radio signal emitted by a car key by which a vehicle can be opened or closed, wherein the car key is used as a remote control.

(4) A specific data signal that is received, for example, via a wireless data link. Such a wireless data link may be connected to a data network, such as, for example, the internet, or can also communicate directly with another vehicle. The vehicle leaving the parking place may be built with an automatic system for emitting a data signal that, after starting of a vehicle, will transmit the message that the vehicle is being moved away from the current position. This data signal preferably also includes a location that is ascertained, for example, by use of a satellite-based position sensor. The receiver of this data signal then recognizes with the aid of this data signal that a specific parking place is becoming free.

The evaluation unit is preferably constructed in such a way that the evaluation of a parking place potentially becoming free is verified. This verification may take place for example by one or more of the following methods:

(1) Analysis of a thermal image of a vehicle parked on a parking place that is potentially becoming free to ascertain whether the engine is cold, a cold engine being evaluated as a parking place that is becoming free. A cold engine signifies that the vehicle was not in operation for long, so that the probability is high, if a signal pattern has been received that is significant for a parking place that is potentially becoming free, that the vehicle is now being moved away from the parking place.

(2) With an analysis of a thermal image or an optical image as to whether at least one person is located in the vehicle, it can be ascertained that no person is located in the vehicle. This means that received signal patterns of an ultrasonic signal, of an optical image analysis and of a data signal, that indicate a parking place that is becoming free, should be discarded, as the vehicle can only be moved from the parking place if at least one person is located in it. Other signals, such as, for example, a radio signal emitted by a car key, do not require a person to be located in the vehicle when the radio signal is emitted. Thus a radio signal emitted by the car key is not verified by an analysis of whether a person is located in the vehicle.

(3) A radio signal emitted by a car key can be verified by checking whether a flashing indicator signal, in particular a hazard light signal, is present within a predetermined time interval after detection of the radio signal. Typically the opening and closing of a vehicle is indicated by simultaneous illumination of the flashing lights.

A radio signal source can be provided that is controlled by the evaluation unit in such a way that it emits radio signals, in order to detect car keys designed as transponders present in the surroundings. These car keys receive a radio signal sent from the radio signal source and send a corresponding radio signal back. This radio signal contains a specific code for opening a specific car. This radio signal can be received with a receiver for radio waves. This radio signal cannot be decoded so that a specific car is opened, but it may be recognized that it originates from a car key. In this way the individual car keys designed as transponders located in the surroundings of the radio signal source can be detected. If only a few or no keys are present in the surroundings of the radio signal source, then the probability that a vehicle is being moved away is low. Therefore the probability that a parking place is becoming free is low.

The system preferably has a camera for recording optical images of a roadway and/or of traffic signs, so that with the evaluation unit an analysis of the recorded images can be carried out as to whether there is a parking area, wherein with the aid of this information a free parking place or a parking place that is potentially becoming free is verified as to whether it is actually located on a parking space.

The system preferably has a camera for recording optical images of an area to the side of the vehicle and/or behind the vehicle, in order, for example, to detect pedestrians walking purposefully to a vehicle. For this purpose the evaluation unit preferably comprises a self-learning system that, with the aid of the gestures and facial expressions of the respective pedestrian and/or further features, such as for example a key located in the hand of the pedestrian, recognizes whether the pedestrian in a targeted manner is walking purposefully towards a vehicle.

An "optical image" is understood to be an image that is detected in the visible wavelength range or in a wavelength range adjacent to the visible wavelength range.

This system is preferably disposed on a vehicle, so that when travelling along specific road sections it is automatically detected whether parking places are free or whether there are parking places that are potentially becoming free.

A method for recognizing a parking place that is potentially becoming free comprises the steps of:

(a) detecting at least one signal typical of a parking place that is potentially becoming free, (b) assessing whether the received signal signifies a parking place that is becoming free, and (c) providing an optical and/or acoustic indication of a parking place that is free or potentially becoming free.

The assessment of a parking place that is potentially becoming free preferably takes place stochastically, in that a probability is assigned to individual signals or signal patterns associated with a specific parking place, wherein from all the probabilities associated with a parking place a resulting probability is determined. Based on the resulting probability a corresponding communication or indication is output as to whether there is a parking place that is potentially becoming free. Depending upon the degree of probability that a parking place is free, different stages of a parking place that is potentially becoming free can be indicated.

Since the system according to the invention for recognizing a parking place that is potentially becoming free is a mobile system, when travelling along specific road sections it can automatically detect parking places that are potentially becoming free. This system is not limited to a specific area and also does not require the collaboration of specific persons. Solely by the detection of a signal that is typical for a parking place that is becoming free, one or more parking places potentially becoming free can be detected and correspondingly indicated to a user.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
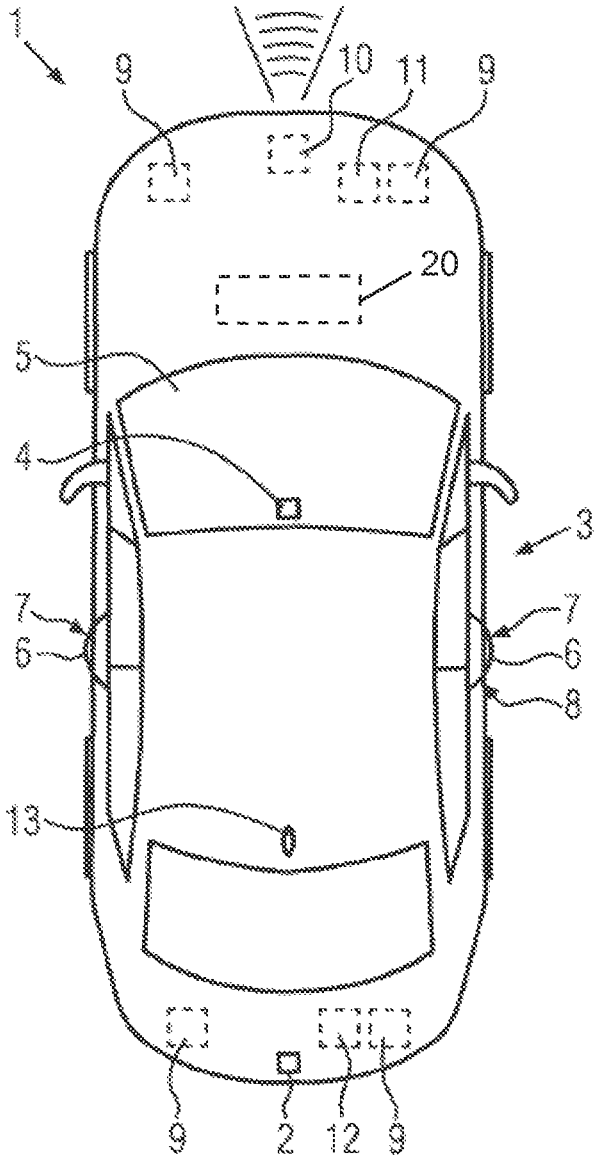
FIG. 1 is a schematic plan view of a vehicle with a mobile system for recognizing a parking place that is free or potentially becoming free.

A mobile system 1 shown in FIG. 1 for a vehicle 3 for recognizing a parking place that is potentially becoming free (parking place finder system) has at least one sensor for detecting a signal typical of a parking place that is becoming free. In addition the parking place finder system can also be designed for recognizing parking places that are already free.

Such a sensor is, for example, a camera 2. In the case of motor vehicles 3, a camera 2 for a parking system is often installed on the rear of the vehicle, and during a reverse drive this camera images the area behind the vehicle on a display screen. Such a rearview camera 2 can be used for the mobile system for recognizing a parking place that is free or potentially becoming free. However, in this connection it is advantageous to extend the field of view of the camera to an area that covers the roadway behind the car as well as the edge of the roadway, in particular a parking lane and a sidewalk.

A camera 4 that is directed towards the front is preferably also provided on the motor vehicle 3 and can record the area in front of the vehicle. The camera 4 is, for example, disposed centrally on the upper edge immediately behind a windshield 5.

It is advantageous to dispose these cameras 2, 4 as far up as possible on the vehicle 3, so that the field of view of the camera extends beyond low obstructions and, for example, so that pedestrians located on the sidewalk can be detected. A camera that is independent of the parking system is preferably provided on the vehicle roof with a field of view to the rear and/or to the side, in particular to the adjacent sidewalk (right-hand drive: to the right of the vehicle; left-hand drive: to the left of the vehicle) and/or to the front.

The cameras 2, 4 are connected to an evaluation 20, shown only schematically. The evaluation unit is a central processor device that is provided in the motor vehicle 3. The connection between the evaluation unit and the sensors, such as for example the cameras 2, 4, takes place by way of a data bus such as, for example, a Controller Area Network (CAN) bus. Images of the roadway, traffic signs and parking areas can be recorded by the cameras 2, 4. These images are subjected to an optical analysis in the evaluation unit, wherein individual elements, such as for example vehicles, the lights thereof, traffic signs, road markings and the like are automatically recognized.

The parking place finder system 1 can also have one or more receivers of radio waves as a sensor. Such receivers of the radio waves 6 are often integrated into door handles 7 of the motor vehicle 3 and serve for reception of radio waves transmitted by a vehicle key for opening and closing the motor vehicle 3. In the parking place finder system 1, these receivers of radio waves are also used for detecting vehicle keys located in the surroundings of the parking place finder system. When a vehicle key, that does not belong to the motor vehicle 3 in which the parking place finder system 1 is installed, emits a radio signal, then the signal emitted by the vehicle key can be received by one of the receivers 6 and it is possible to detect that a vehicle key is present in the surroundings of the parking place finder system 1. Preferably, a plurality of receivers 6 are integrated in the parking place finder system 1, so that by superimposition of the signals from the plurality of receivers it is possible to find the position of the radio signal emitted by the respective vehicle key, so that the direction of the radio signal can be ascertained approximately.

The parking place finder system 1 preferably has a transmitter of radio waves 8 that is designed, in particular, for transmission of radio waves to address vehicle keys. These radio waves are usually in the ISBN band. Vehicle keys that designed as transponders and are located in the surroundings of the parking place finder system are addressed by the transmission of these radio waves in the surroundings of the parking place tinder system 1, so that these vehicle keys emit a response signal after the reception of this signal. This response signal can be received by receivers 6. As a result it is possible to search the surroundings of the parking place finder system 1 systematically for vehicle keys that are designed as transponders.

The parking place finder system 1 can also have one or more ultrasonic sensors 9. Ultrasound sensors that are already provided for a distance measuring system and are connected to the evaluation unit are preferably used. The ultrasound sensors 9 preferably have a high sensitivity, so that ultrasonic signals from distance measuring systems of other motor vehicles can be detected. In this way it is possible to ascertain whether a distance measuring system, that is generally switched on for parking a motor vehicle or leaving a parking place, is active.

Figure 3:
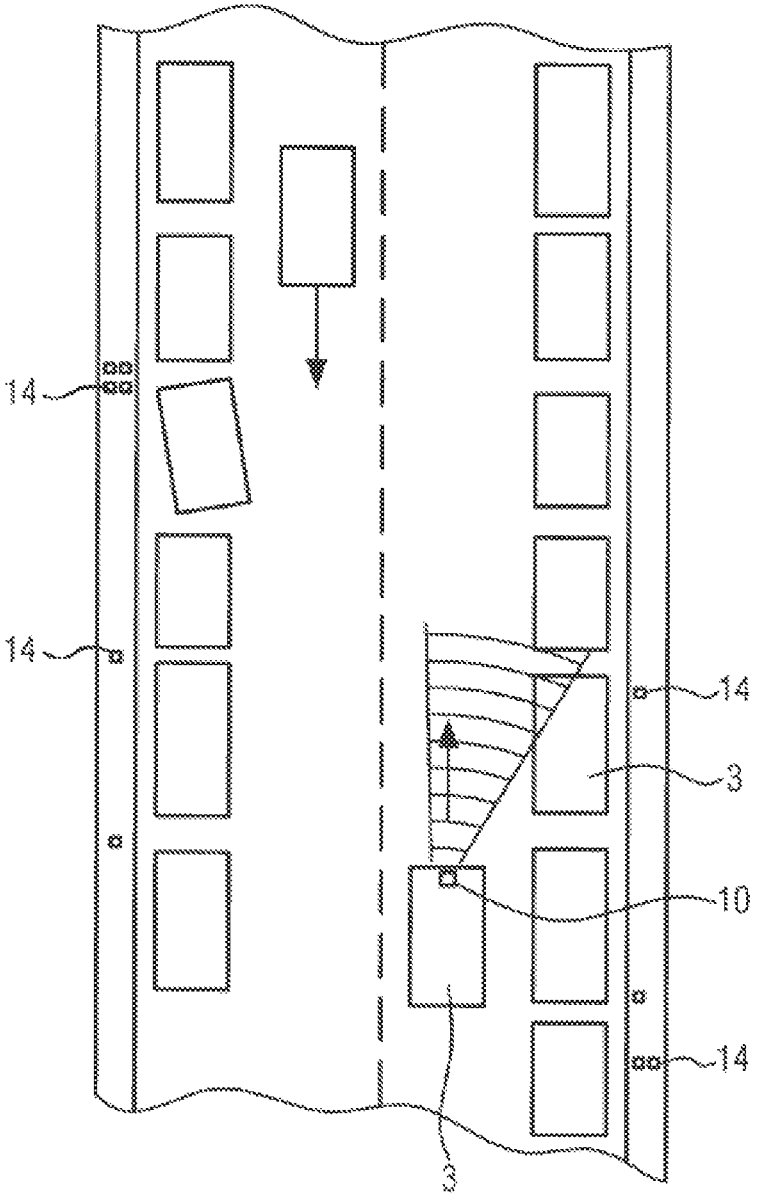
FIG. 3 is a simplified schematic plan view of a section of a road with a plurality of vehicles.

A further suitable sensor for the parking place finder system 1 is a radar system 10. Such radar systems 10 are used, above all, in traffic for measuring the distance to the vehicle in front. If such a radar system 10 is integrated in the parking place finder system then it is preferably designed in such a way that vehicles located at the side of a road are detected (FIG. 3). If the vehicle is designed for right-hand drive, then the line of sight of the radar is oriented forwards and slightly to the right with respect to the travel direction of the vehicle. In a left-hand drive vehicle the line of sight of the radar system is oriented forwards and slightly to the left. When passing parked vehicles these can be recognized and, if there is a space then this free parking place is identified immediately by the radar system 10.

A further sensor of the parking place finder system 1 is a thermal imaging camera 11 that is disposed with its line of sight forward travel direction. In a right-hand drive vehicle the thermal imaging camera 11 is preferably oriented approximately forward and to the right and in a left-hand drive vehicle the camera is oriented approximately forward and to the left, in order to detect vehicles parked at the side of the road. Preferably two thermal imaging cameras 11 are provided, wherein the second thermal imaging camera is oriented to the rear in the travel direction.

A further sensor of the parking place finder system 1 is a satellite-based position sensor 13 by which the position of the parking place finder system 1 can be ascertained. This satellite-based position sensor 13 differs from the sensors explained above in that with a characteristic of the parking place finder system, namely its position can be ascertained, whereas with the other sensors specific characteristics of the surroundings can be ascertained that allow conclusions to be drawn about the parking place situation. The sensors 2, 4, 6, 9, 10, 11, 12 in each case detect physical signals that are emitted or influenced by elements of the surroundings of the parking place finder system 1. These elements are in particular vehicles, car keys, the roadway and traffic signs.

A further sensor of the parking place finder system 1 is a receiver for a wireless data link (not shown) by which data signals can be received. These data signals may contain different information, such as for example maps with a description of the parking place situation, a message sent from a vehicle leaving a parking place that a particular parking place is becoming free, or statistical information that describes the probability of finding a parking place on specific road sections.

A method for recognizing a parking place that is free or potentially becoming free is explained below.

In principle the assessment of a parking place that is potentially becoming free takes place stochastically, i.e. for an individual parking place a probability is calculated that it will become free within a predetermined time interval of, for example, a few minutes (1-3 minutes). A free parking place has the probability 1. A parking place that is occupied by a vehicle and for which no information is available that the vehicle will leave the parking place has the probability 0. The probabilities for the individual parking spaces are ascertained by the evaluation unit.

Figure 2:
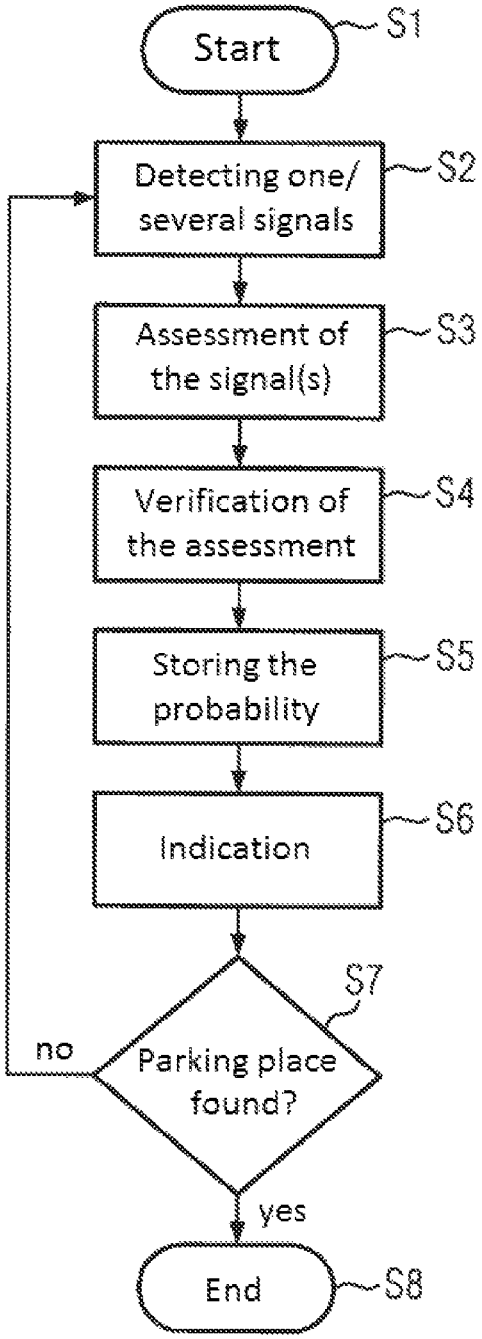
FIG. 2 is a flow chart illustrating essential steps of an embodiment of a method for recognizing a parking place that is free or potentially becoming free.

The method illustrated in FIG. 2 begins with the step S1 (start) in which, for example in a vehicle in which a parking place finder system is provided, the driver starts the search for a parking place by operating a knob or switch. In the step S2 signals that are typical for a parking place that is becoming free are detected by one or more of the sensors. These signals are optical images, sound waves, radio waves, ultrasonic signals, radar measurements and/or thermal images. In addition, the position can be ascertained by a satellite-based position sensor and/or additional information can be received via a wireless data link.

The received signals are assessed in the step S3 by an evaluation unit. In assessment of the signals, firstly all relevant signals that signify a parking place that is potentially becoming free or a free parking place are filtered out. Probabilities are calculated from these signals and these probabilities are assigned to specific parking places. The local assignment of signals to specific parking places is not always unambiguous, which is why it may also be sensible to assign the probabilities of specific signals to an area that encompasses a plurality of parking places. Thus for the individual parking places at least one probability and preferably a plurality of probabilities are stored that have each been derived from different signals.

The detection of a specific signal can take place in different ways. Optical images of a vehicle can be analyzed to ascertain whether the vehicle is located in a position and/or whether flashing light signals emitted by the respective vehicle are present that are typical for a vehicle leaving a parking place. In this connection is advantageous to analyze chronologically staggered images so that a movement of the vehicle can be recognized. From the optical data analysis of chronologically staggered images it is also possible to recognize the switching on of vehicle lights and/or the switching off of vehicle interior lights. These are each clear signs that the vehicle will leave a parking place.

Optical images can also analyze whether any pedestrians are walking purposefully to a vehicle. In this case the gestures and facial expressions and/or postures of the entire bodies of the respective pedestrians and/or further features, such as, for example, a key located in the hand of a pedestrian, are recognized and assessed as to whether the pedestrian is walking purposefully towards a vehicle.

The evaluation unit preferably comprises a self-learning system that can be trained with corresponding images from which it is known that the vehicle has left the parking area or has remained on the parking area. For this purpose the evaluation unit can have a neural network, in particular a perceptron. With such a self-learning system complex correlations can be registered and evaluated.

The self-learning system can also be used for evaluating a plurality of or all available signals for free parking spaces or parking places that are becoming free and for ascertaining the probability of one or more parking places becoming free.

A further detectable signal is a radio signal emitted by a car key in order to open a vehicle. The detectable car keys may also be located with persons 14 outside the vehicles. FIG. 3 shows schematically a plurality of persons 14 on a sidewalk. If the car keys can be associated with a specific parked vehicle, then by chronologically staggered detection of the car keys and their position it is possible to ascertain whether the car keys are moving towards the respective vehicle or away from the respective vehicle. Thus it can be determined whether the persons who have the respective vehicle keys are walking towards the respective vehicle or are walking away from this vehicle. If they are walking towards this vehicle, then this signifies that the probability is high that the vehicle will shortly leave the parking place. If the persons are walking away from the vehicle, then on the other hand this signifies that the vehicle will remain on the parking place.

Also, a data signal can be received from another vehicle, indicating that the other vehicle intends to leave a parking place. This data signal can be transmitted via a network (for example a mobile communication network, a wireless local area network WLAN and/or a wide area network WAN or the Internet) or via a vehicle-to-vehicle data link.

Furthermore, by use of the radio signal source 8, radio signals can be output that are received by car keys present in the surroundings of the parking place finder system. If these car keys are formed as transponders, then they detect the radio signals and convert them into corresponding answering radio signals that they send back. These answering radio signals are received by the receiver for radio waves. As a result the surroundings of the parking place finder system can be scanned for car keys formed as transponders. If only a small number of car keys are present in the surroundings, then the probability that a vehicle is leaving a parking place is low. This can be taken into account in the verification of the assessments. If, for example, no car key is present, then in principle it is not possible that a vehicle is being moved.

These assessments in the form of probabilities are verified (step S4). For example, by means of the analysis of a thermal image it is ascertained whether the engine of a specific vehicle is cold. If there are signals present relating to this vehicle that signify an operation of parking or leaving a parking place, then the cold engine signifies with a high probability that the vehicle is not being parked but rather is being moved away from a parking place and this parking place is becoming free. The corresponding probability can therefore be confirmed or even increased.

In a further verification of the assessments, a thermal image and/or an optical image is analyzed as to whether at least one person is located in the vehicle. If no person is located in the vehicle, then an assessment based on an ultrasonic signal, an optical image analysis or a data signal that this parking place should become free is discarded. With these signal patterns (ultrasound, optical image analysis or data signal) it is necessary that a person operates the vehicle, otherwise the corresponding signals cannot be generated. Discard of the assessment signifies that the corresponding probability is set to 0. However, this does not apply to a radio signal that has been emitted by a car key in order to open a vehicle. Such a signal also leads to the conclusion that the corresponding vehicle is to be moved away from the respective parking place. However, this signal is generated without a user being in the vehicle.

An assessment of a detected signal can also take place by detecting by way of an optical image analysis a flashing indicator signal that has been detected within a predetermined time interval after reception of a radio signal emitted by a car key. In vehicles the opening of the vehicle is indicated by a corresponding flashing indicator signal that occurs shortly after the car key has been actuated. A conclusion as to the opening of the vehicle can be drawn from this coincidence of timing. In this way, on the one hand, the signal is verified and, on the other hand, it is also associated exactly with a vehicle, i.e. located.

Furthermore, images of a roadway and/or of traffic signs can be analyzed by the evaluation unit as to whether there are parking areas, and these detected parking areas can also be taken into consideration in the verification of the assessment. For example, signals from a vehicle that is not disposed on a parking area, for example if it is parked in a no waiting zone, are discarded.

After the verification of the assessments, the probabilities assigned to the individual parking places are stored (step S5). If there are several probabilities for a specific parking place, then they are combined, for example by multiplication, into one single probability. The resulting probability is then stored for the respective parking place.

Parking places that are free and potentially becoming free are indicated to the user by an indication (step S6). The indication can take place as an optical and/or acoustic signal. For example, the parking places that are free or becoming free can be marked in green on a pictorial representation of a road section or of a parking area and the occupied parking places are marked in red. The probability can be represented by the color intensity, wherein a parking place with a probability of 1 is represented by green with a high brightness and a parking place with a lower probability is represented by green with a lower brightness. With an optical indication a plurality of parking places can be indicated simultaneously. An acoustic indication is preferably used when, with a very high probability, a specific parking place in the immediate surroundings is becoming free. Then a corresponding announcement with an automatic voice is generated.

In the step S7 it is checked whether a parking place has been found. This can be ascertained automatically, for example if the satellite-based position sensor ascertains that a location of the vehicle corresponds to a parking place. However, other possibilities are also contemplated here for ascertaining whether a parking place has been found. For example, the switching off of the engine by the user of the vehicle can be assessed as ending the search for a parking place. If in the step S7 it is ascertained that a parking place has been found, then the method moves onto the step S8 by which it is ended.

On the other hand, if in the step S7 it is not ascertained that a parking place has been found, then the method goes back to the step S2. Further signals are detected and a search is performed again for further parking places that are free or potentially becoming free.

LIST OF REFERENCE SIGNS

1 system (parking place finder system)
2 camera
3 motor vehicle
4 camera
5 windshield
6 receiver of radio waves
7 door handle
8 transmitter of radio waves
9 ultrasound sensor
10 radar system
11 thermal imaging camera
12 thermal imaging camera.
13 satellite-based position sensor
14 persons The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A mobile system for a vehicle for recognizing a parking place that is potentially becoming free, the mobile system comprising:

at least one sensor for detecting one or more signals;

an evaluation unit for assessing the one or more signals detected by the sensor, wherein the evaluation unit is configured to:

identify and filter out any signal from the one or more detected signals that signifies one or more parking places is potentially becoming free, determine at least one probability associated with the one or more parking places potentially becoming free based on the filtered signals, verify the at least one probability using distinct verification analysis, wherein the at least one probability is confirmed or modified based on the verification, and assign the verified at least one probability to one or more of: (i) a parking place of the one or more parking places and (ii) an area encompassing the parking place of the one or more parking places; and one or more of an optical indicator unit and an acoustic indicator unit for indicating that the parking place is free or potentially becoming free based on the assigned at least one probability.

2. The system according to claim 1, wherein the at least one sensor comprises:

one of a camera, a microphone, a receiver of radio waves, an ultrasound sensor, a radar system, a thermal imaging camera, a satellite-based position sensor, a wireless data link, or a combination of two or more of the above.

3. The system according to claim 1, wherein the evaluation unit is configured such that predetermined signal patterns of the detected one or more signals are identified as a parking place that is free or potentially becoming free.

4. The system according to claim 3, wherein the evaluation unit includes a self-learning system.

5. The system according to claim 3, wherein the predetermined signal patterns include one or more of:

(a) ultrasonic signal, (b) optical image analysis of a vehicle, with regard to one or more of the following: (i) position and flashing light signals emitted by the vehicle, (ii) the switching on of vehicle lights by comparison of chronologically staggered images of the vehicle, (iii) the switching off of vehicle interior lighting by comparison of chronologically staggered images of the vehicle, (iv) pedestrians either moving purposefully towards the vehicle, and (v) pedestrians holding a key in the hand;

(c) a radio signal emitted by a car key, and (d) a specific data signal.

6. The system according to claim 5, wherein the distinct verification analysis includes one or more of the following:

(a) analysis of a thermal image of a vehicle parked on a parking place that is potentially becoming free to ascertain whether the engine is cold, a cold engine being evaluated as a parking place that is becoming free, (b) analysis of one or more of a thermal image and an optical analysis of an optical image as to whether at least one person is located in the vehicle, and if no person is located in the vehicle the signal patterns of ultrasonic signal, optical image analysis and data signal as a parking place that is becoming free is discarded, (c) checking of the sound emitted by a vehicle standing on a parking place that is potentially becoming free as to whether the engine of this vehicle is in operation is, and (d) checking whether the detection of a flashing indicator signal and the radio signal emitted by a car key occurred within a predetermined time interval.

7. The system according to claim 1, further comprising:

a radio signal source controlled by the evaluation unit such that the radio signal source emits radio signals, in order to detect car keys designed as transponders present in the surroundings, and wherein non-detection of car keys is assessed as a low probability of a parking place that is becoming free.

8. The system according to claim 2, wherein the camera is designed for recording images of one or more of a roadway and traffic signs and the evaluation unit is designed to carry out an analysis of the recorded images as to whether there is a parking area, wherein a free parking place or a parking place that is potentially becoming free is verified as to whether it is located on a parking area.

9. A method for recognizing a parking place that is potentially becoming free, the method comprising the acts of:

detecting, via at least one sensor, one or more signals;

assessing, via an evaluation unit, the one or more signals detected by the sensor, wherein the act of assessing comprises:

identifying and filtering, via the evaluation unit, out any signal from the one or more detected signals signifying that one or more parking places is potentially becoming free, determining, via the evaluation unit, at least one probability associated with the one or more parking places potentially becoming free based on the filtered signals, verifying, via the evaluation unit, the at least one probability using distinct verification analysis, wherein the at least one probability is confirmed or modified based on the verification, and assigning, via the evaluation unit, the verified at least one probability to one or more of: (i) a parking place of the one or more parking places and (ii) an area encompassing the parking place of the one or more parking places; and providing, via one or more of an optical indicator unit and an acoustic indicator unit, one or more of an optical indication and an acoustic indication that the parking place is free or potentially becoming free based on the assigned at least one probability.

10. The method according to claim 9, wherein the act of assessing, via the evaluation unit, is carried out by assessing predetermined signal patterns of the detected one or more signals in order to identify that a parking place is free or potentially becoming free.

11. The method according to claim 10, wherein the predetermined signal patterns include one or more of:

(a) ultrasonic signal, (b) optical image analysis of a vehicle, with regard to one or more of the following: (i) position and flashing light signals emitted by the vehicle, (ii) the switching on of vehicle lights by comparison of chronologically staggered images of the vehicle, (iii) the switching off of vehicle interior lighting by comparison of chronologically staggered images of the vehicle, (iv) pedestrians either moving purposefully towards the vehicle, and (v) pedestrians holding a key in the hand;

(c) a radio signal emitted by a car key, and (d) a specific data signal.

12. The method according to claim 11, wherein the distinct verification analysis includes one or more of the following:

(a) analysis of a thermal image of a vehicle parked on a parking place that is potentially becoming free to ascertain whether the engine is cold, a cold engine being evaluated as a parking place that is becoming free, (b) analysis of one or more of a thermal image and an optical analysis of an optical image as to whether at least one person is located in the vehicle, and if no person is located in the vehicle the signal patterns of ultrasonic signal, optical image analysis and data signal as a parking place that is becoming free is discarded, (c) checking of the sound emitted by a vehicle standing on a parking place that is potentially becoming free as to whether the engine of this vehicle is in operation is, and (d) checking whether the detection of a flashing indicator signal and the radio signal emitted by a car key occurred within a predetermined time interval.

13. The method according to claim 9, further comprising the act of:

outputting, via a radio signal source, radio signals in order to detect car keys designed as transponders present in the surroundings, wherein non-detection of car keys is assessed as a low probability of a parking place that is becoming free.

14. The method according to claim 9, wherein the act of detecting is carried out by:

recording, via a camera, images of one or more of a roadway and traffic signs; and analyzing, via the evaluation unit, the recorded images as to whether there is a parking place, wherein a free parking place or a parking place that is potentially becoming free is verified as to whether it is located on a parking area.

15. The method according to claim 9, wherein the act of assessing is carried out by:

performing, via the evaluation unit, a stochastic analysis, wherein a probability is assigned to individual signals or signal patterns associated with a specific parking place, all of the assigned probabilities associated with the specific parking place are used to determine a resulting provability, and a corresponding notification is output based on the resulting probability.

16. A vehicle, comprising:

a mobile system for recognizing a parking place that is potentially becoming free, the mobile system comprising:

at least one sensor for detecting one or more signals;

an evaluation unit for assessing the one or more signals detected by the sensor, wherein the evaluation unit is configured to:

identify and filter out any signal from the one or more detected signals signifying that one or more parking places is potentially becoming free, determine at least one probability associated with the one or more parking places potentially becoming free based on the filtered signals, verify the at least one probability using distinct verification analysis, wherein the at least one probability is confirmed or modified based on the verification, and assign the verified at least one probability to one or more of: (i) a parking place of the one or more parking places and (ii) an area encompassing the parking place of the one or more parking places; and one or more of an optical indicator unit and an acoustic indicator unit for indicating that the parking place is free or potentially becoming free based on the assigned at least one probability.

17. The vehicle according to claim 16, wherein the at least one sensor comprises:

one of a camera, a microphone, a receiver of radio waves, an ultrasound sensor, a radar system, a thermal imaging camera, a satellite-based position sensor, a wireless data link, or a combination of two or more of the above.

18. The vehicle according to claim 16, wherein the evaluation unit is configured such that predetermined signal patterns of the detected one or more signals are identified as a parking place that is free or potentially becoming free.

19. The vehicle according to claim 16, wherein the evaluation unit includes a self-learning system.

20. The system according to claim 1, wherein the at least one probability and other probabilities assigned to the one or more of the parking place and the area encompassing the parking place, when present, are combined into a single probability.

* * * * *